US008267549B2

(12) United States Patent
Hwang et al.

(10) Patent No.: US 8,267,549 B2
(45) Date of Patent: Sep. 18, 2012

(54) ILLUMINATION DEVICE

(75) Inventors: Jyh-Der Hwang, Miao-Li Hsien (TW); Chao-Yi Yeh, Miao-Li Hsien (TW); Shan-Ju Lin, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 330 days.

(21) Appl. No.: 12/775,484

(22) Filed: May 7, 2010

(65) Prior Publication Data

US 2011/0002125 A1 Jan. 6, 2011

(30) Foreign Application Priority Data

Jul. 2, 2009 (CN) ..... 2009 1 0303950

(51) Int. Cl.
*F21V 29/00* (2006.01)

(52) U.S. Cl. ..... 362/294; 362/218; 362/245

(58) Field of Classification Search ..... 362/218, 362/217.05, 243, 245, 249.02, 294, 345
See application file for complete search history.

(56) References Cited

U.S. PATENT DOCUMENTS

| | | | | |
|---|---|---|---|---|
| 6,582,103 | B1 | 6/2003 | Popovich et al. | |
| 6,948,829 | B2 * | 9/2005 | Verdes et al. | 362/227 |
| 7,815,338 | B2 * | 10/2010 | Siemiet et al. | 362/218 |
| 2002/0093820 | A1 * | 7/2002 | Pederson | 362/241 |
| 2002/0176251 | A1 | 11/2002 | Plank et al. | |
| 2003/0039119 | A1 * | 2/2003 | Cao | 362/227 |
| 2004/0223327 | A1 * | 11/2004 | Kuan et al. | 362/249 |
| 2005/0201098 | A1 * | 9/2005 | DiPenti et al. | 362/294 |
| 2006/0146531 | A1 | 7/2006 | Reo et al. | |

FOREIGN PATENT DOCUMENTS

| | | | |
|---|---|---|---|
| CN | 101356858 | | 1/2009 |
| DE | 20215834 | U1 | 2/2004 |
| DE | 102007053545 | A1 | 4/2009 |
| DE | 202008017219 | U1 | 4/2009 |
| EP | 2051001 | A2 | 4/2009 |
| EP | 2151621 | A1 | 2/2010 |
| WO | 0124583 | A1 | 4/2001 |
| WO | 2006067777 | A2 | 6/2006 |
| WO | 2007090292 | | 8/2007 |
| WO | 2007090292 | A1 | 8/2007 |
| WO | 2009035203 | A1 | 3/2009 |

* cited by examiner

*Primary Examiner* — David V Bruce
(74) *Attorney, Agent, or Firm* — Altis Law Group, Inc.

(57) ABSTRACT

An illumination device includes a cover, a heat-dissipation module, and a plurality of light emitting units. The heat-dissipation module includes a main body and a mounting plate connected to the main body. The mounting plate is received in the interior of the illumination device. The light emitting units are mounted on the mounting plate and opposite to the cover. Light from the light emitting unit is transmitted through the cover.

16 Claims, 8 Drawing Sheets

ILLUMINATION DEVICE

BACKGROUND

1. Technical Field

The disclosure relates generally to illumination, and more particularly to an illumination device with efficient heat-dissipation.

2. Description of the Related Art

In general, an LED-based illumination device employs a heat-dissipation module, such as a fan, a passive heat sink, or other, for dissipation of generated heat. When the fan is employed, the illumination device is bulky and expensive. When the passive heat sink is employed, however, efficiency of heat dissipation suffers. Thus, what is called for is an illumination device utilizing a heat-dissipation system that can overcome the limitations described.

DETAILED DESCRIPTION

Figure 1:
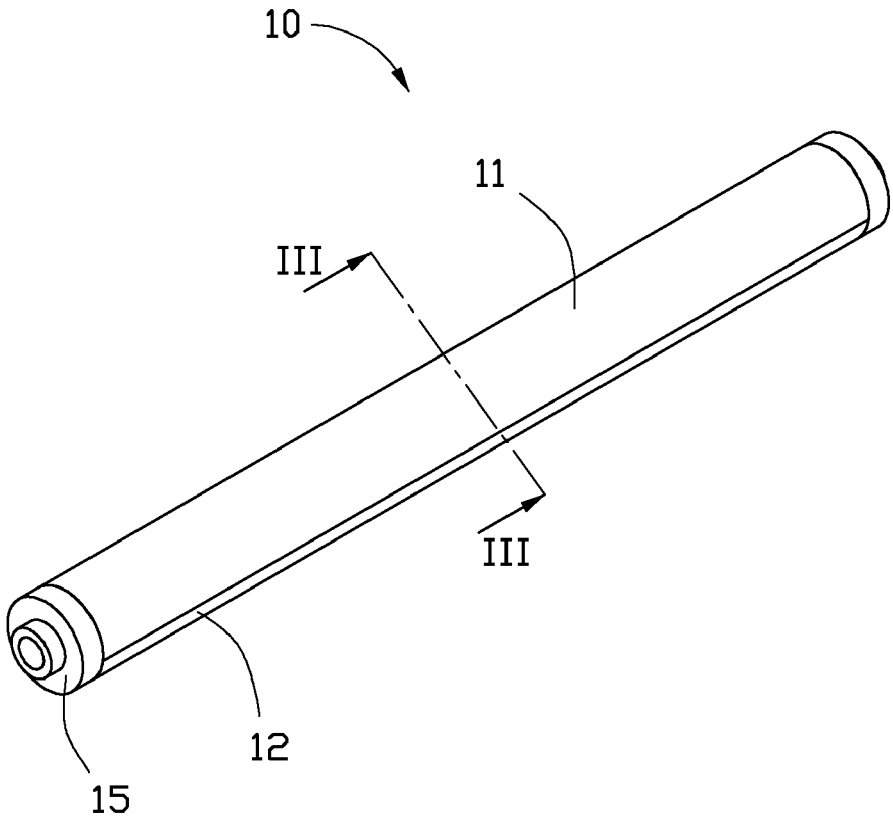
FIG. 1 is an isometric view of an illumination device in accordance with a first embodiment of the disclosure.
Figure 2:
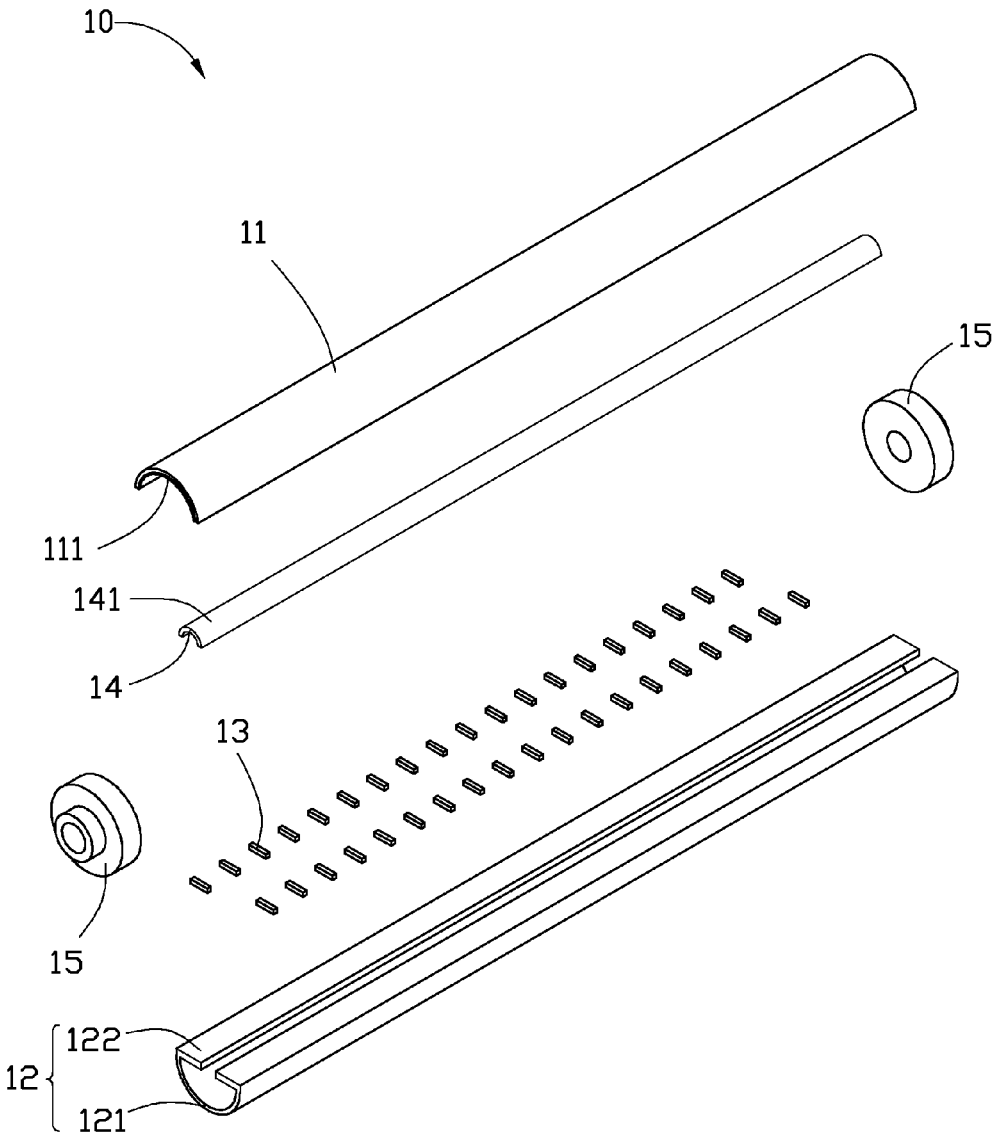
FIG. 2 is an exploded view of the illumination device of FIG. 1.
Figure 3:
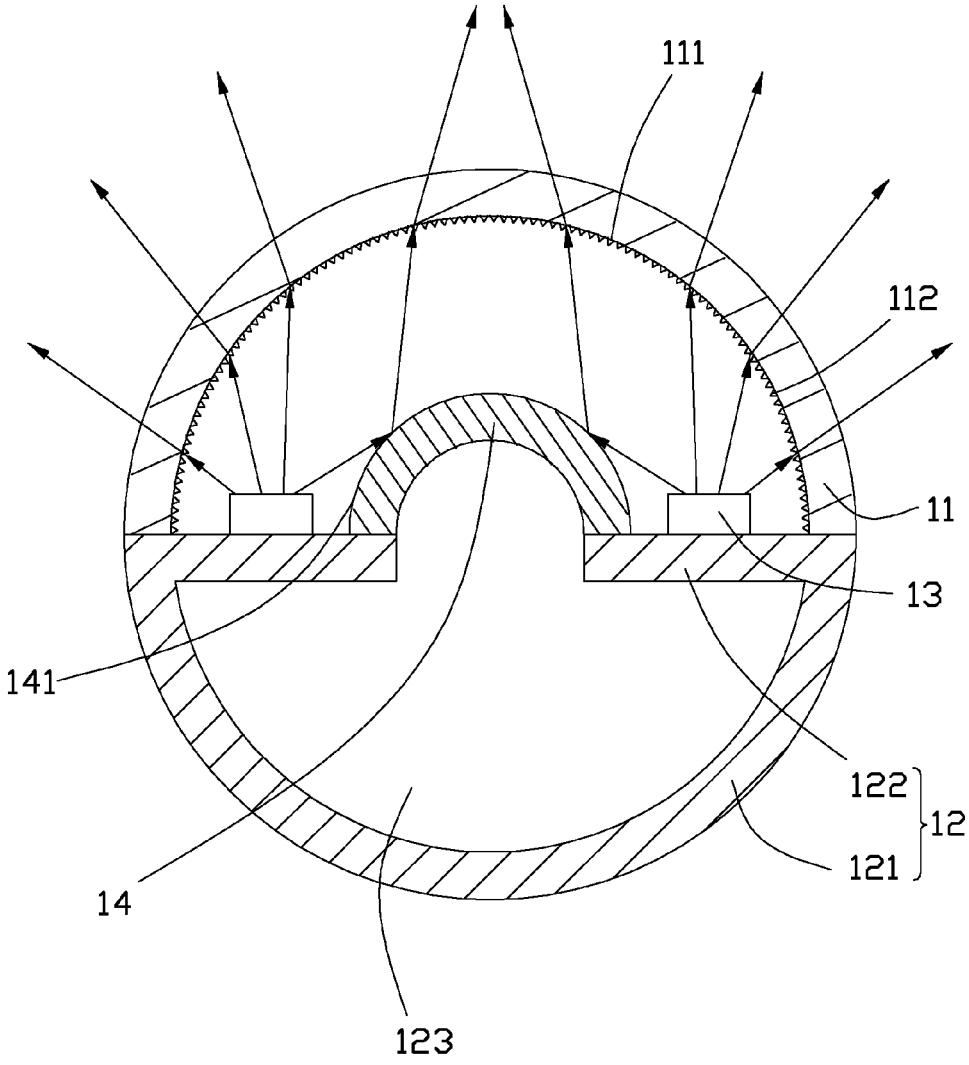
FIG. 3 is a cross-section along line III-III of the illumination device of FIG. 1.

Referring to FIG. 1, FIG. 2 and FIG. 3, an illumination device 10 in accordance with a first embodiment of the disclosure includes a cover 11, a heat-dissipation module 12 and a plurality of light emitting units 13.

The cover 11 is hollow and semi-cylindrical. The cover 11 is transparent glass or a synthetic resin. Optimally, a plurality of saw-toothed micro-structures 112 is formed on an inner surface 111 of the cover 11, uniformly transmitting the light from the light emitting units 13 out.

The heat-dissipation module 12 includes a main body 121 and two mounting plates 122. The main body 121 is hollow and semi-cylindrical. A slot (not labeled) is defined between the two mounting plates 122 in the main body 121. The heat-dissipation module 12 is of heat conductive material. Preferably, the heat-dissipation module 12 is made of metal such as aluminum, steel or copper.

The light emitting units 13 are mounted on the mounting plates 122 and opposite to the cover 11. The light emitting units 13 are thermally connected to the mounting plates 122. The light emitting units 13 are LEDs 13.

Optimally, the illumination device 10 further includes a reflecting shell 14 and two connectors 15. The reflecting shell 14 is received in an interior 123 of the illumination device 10. The reflecting shell 14 is connected to the mounting plates 122. The reflecting shell 14 has a curved reflective surface 141. The curved reflective surface 141 is opposite to the cover 11. The cover 11 and the heat-dissipation module 12 are secured by the connectors 15 which further connect the illumination device 10 to the peripheral devices. The peripheral devices in this embodiment are sockets (not shown) of a standard fluorescent lamp fixture (not shown) whereby an external electric power can be supplied to the illumination device 10.

Figure 4:
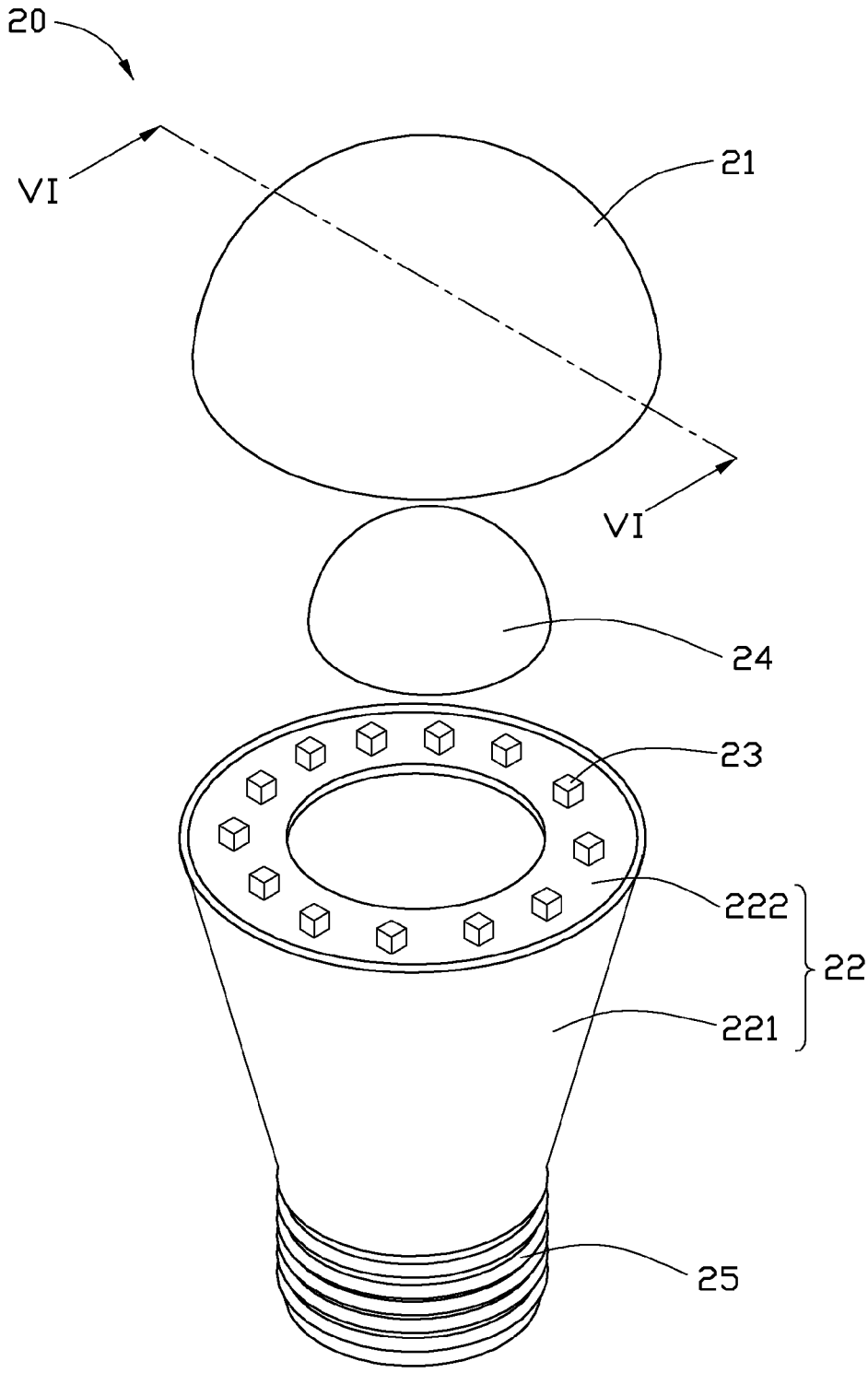
FIG. 4 is an exploded view of an illumination device in accordance with a second embodiment of the disclosure.
Figure 5:
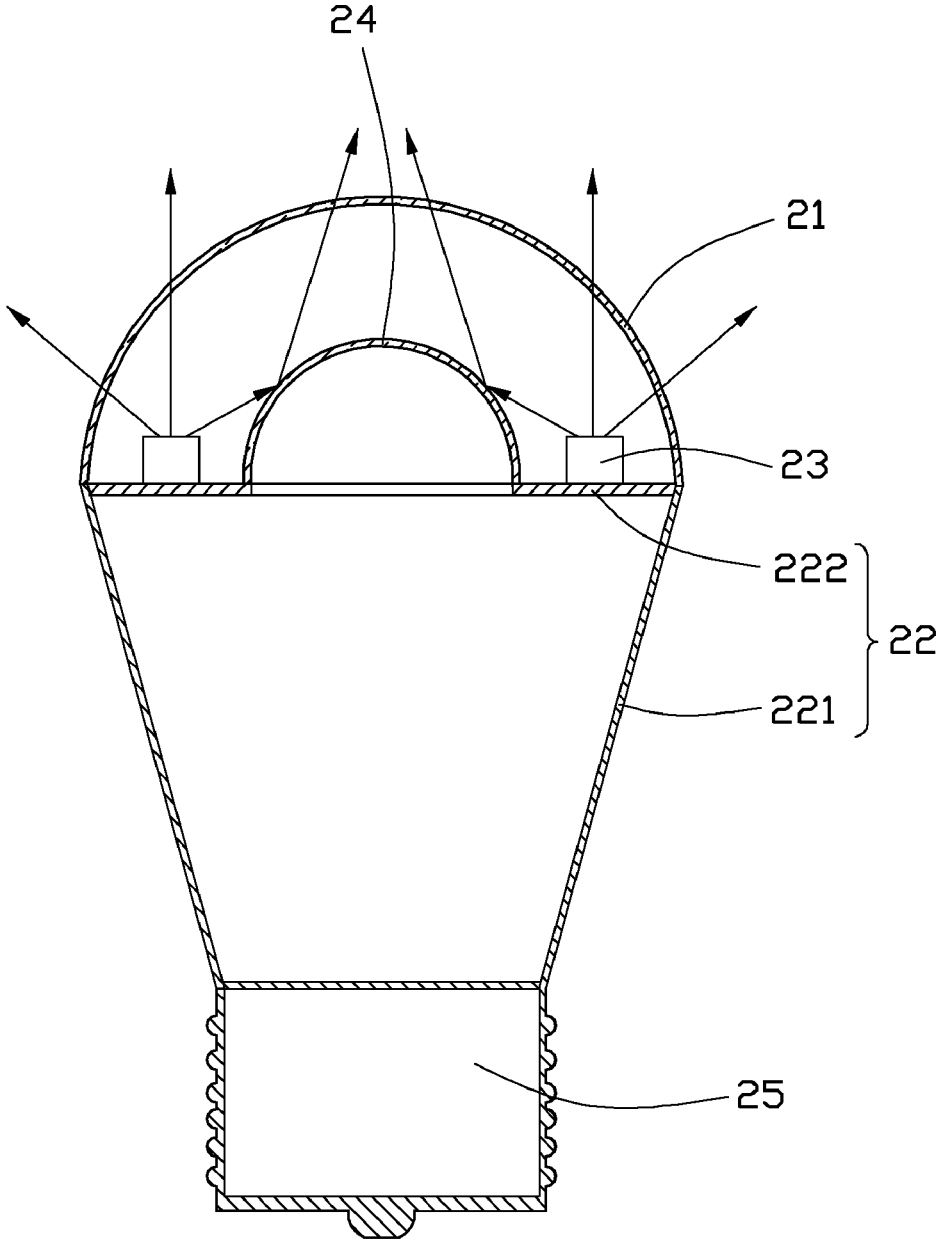
FIG. 5 is a cross-section along line IV-IV of the illumination device of FIG. 4.

The light emitting units 13 are mounted on the mounting plates 122 of the heat-dissipation module 12. The heat-dissipation module 12 is configured for dissipating heat generated by the light emitting units. The cover 11 and the main body 121 together have a tubular configuration like a standard fluorescent bulb. Particularly referring to FIG. 3, the arced reflecting shell 14 straddles on two facing inner sides of the mounting plates 122, with the outer reflective surface 141 neighboring the light emitting units 13, whereby a part of light generated by the light emitting units 13 is reflected by the arced reflective surface 141 to radiate out of the illumination device 10, whereby a more even illumination can be obtained Referring to FIG. 4 and FIG. 5, an illumination device 20 in accordance with a second embodiment of the disclosure is shown. The illumination device 20 has a configuration like an incandescent bulb. The illumination device 20 consists of a heat-dissipation module 22 having a main body 221 and a mounting plate 222 and a plurality of light emitting units 23.

The main body 221 of the heat-dissipation module 22 is essentially conical with truncated ends. The mounting plate 222 is annular and connected to an end (i.e., top end) of the main body 221. The light emitting units 23 are mounted on the mounting plate 222. The light emitting units 23 are thermally connected to the mounting plate 222. An arced cover 21 made of transparent glass or plastic is mounted on an outer edge of the mounting plate 222. An arced reflecting shell 24 is mounted on an inner edge of the mounting plate 222, located below and enclosed by the cover 21. The light emitting units 23 surround an arced outer reflective surface (not labeled) of the reflecting shell 24 and located between the cover 21 and the reflecting shell 24.

A connector 25 is mounted on an opposite end (i.e., bottom end) of the main body 221 for electrically connecting the illumination device 20 to a peripheral device, which according to this embodiment is a lamp socket for a standard incandescent bulb. The connector 25 is formed with a plurality of threads thereon. Particularly referring to FIG. 5, a part of light generated by the light emitting units 23 is reflected by the arced reflective surface of the reflecting shell 24 to radiate out of the illumination device 20, whereby a more even illumination can be obtained. The light emitting units 23 are LEDs 23.

Figure 6:
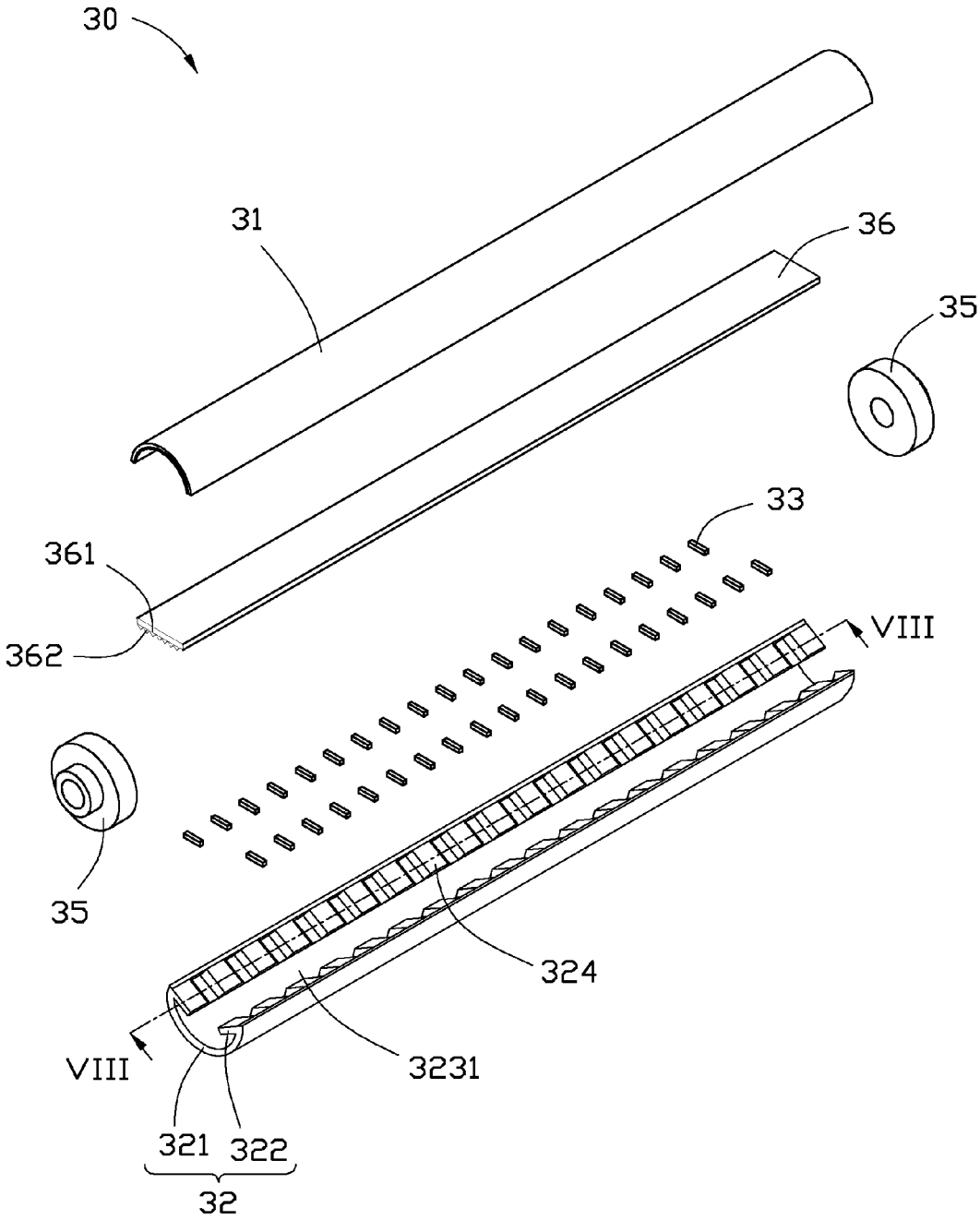
FIG. 6 is an exploded view of an illumination device in accordance with a third embodiment of the disclosure.
Figure 7:
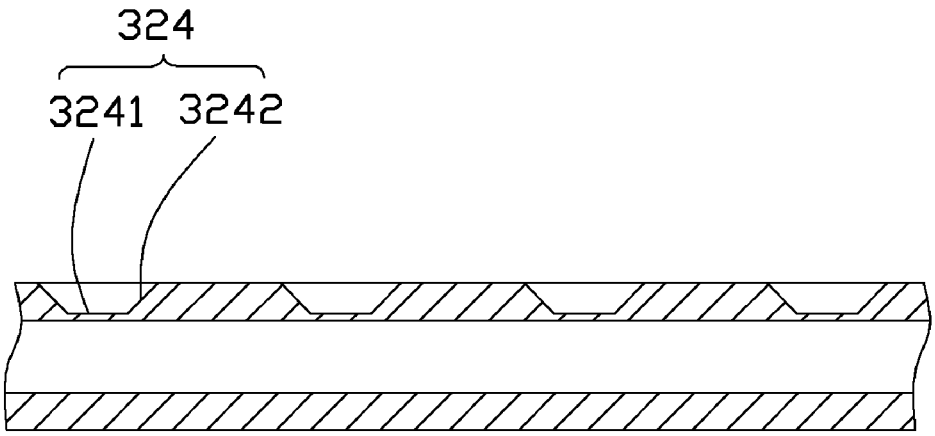
FIG. 7 is a portion of a cross section of a mounting plate of a heat-dissipation module of the illumination device of FIG. 6, taken along line VIII-VIII thereof.
Figure 8:
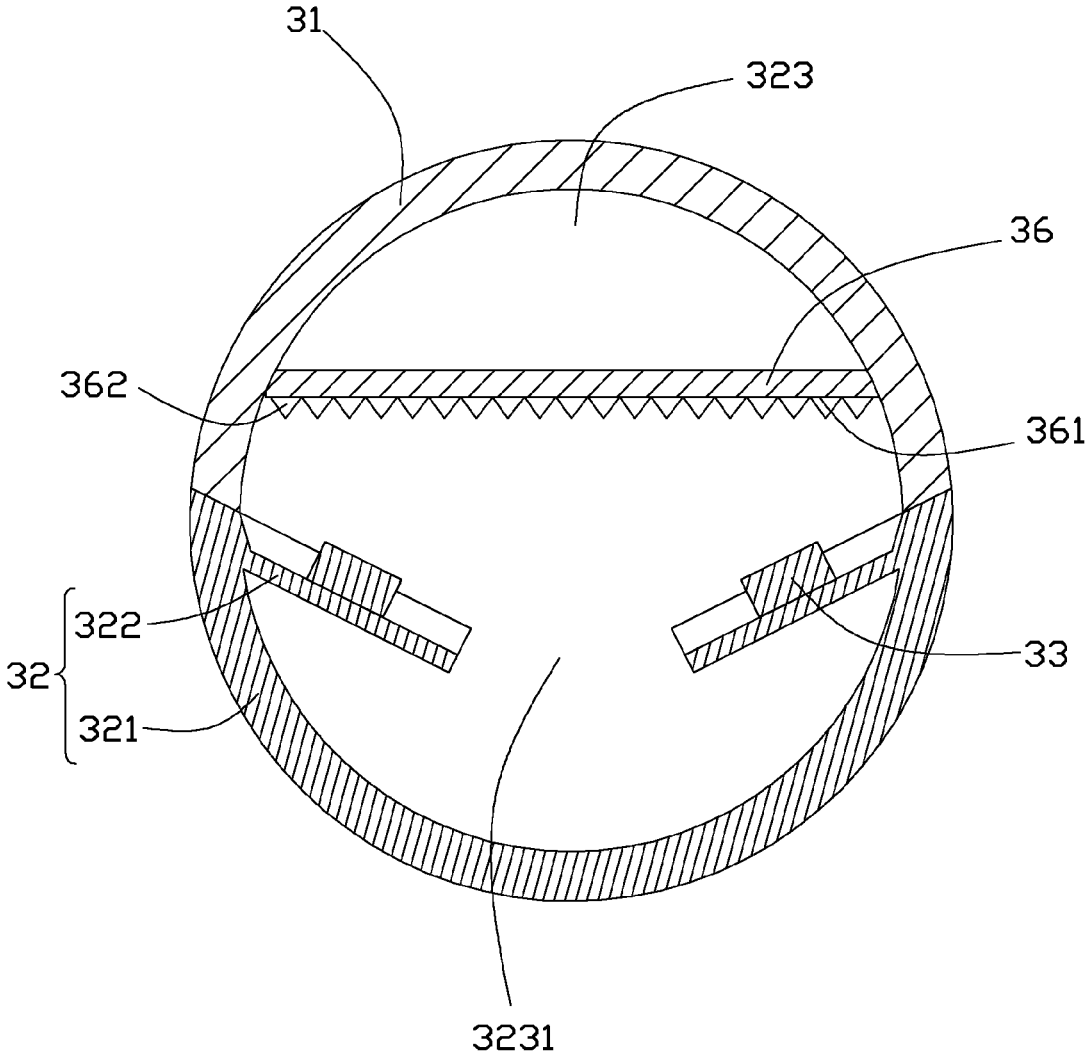
FIG. 8 is a transversely cross section of the illumination device of FIG. 6 in an assembled state.

Referring to FIGS. 6-8, an illumination device 30 in accordance with a third embodiment of the disclosure differs from the first embodiment only in that mounting plates 322 of the heat dissipation module 32 each include a plurality of mounting portions 324, and the illumination device 30 includes a lens 36 received in an interior 323 of the illumination device 30 to replace the reflecting shell 14. The mounting plates 322 have a configuration and a position different from those of the mounting plats 122 of the first embodiment. The mounting plates 122 are horizontal, while the mounting plates 322 are inclined inwardly and downwardly.

A slot 3231 is defined between the mounting plates 322 in the main body 321. The mounting plate 322 includes a plurality of recessed mounting portions 324. The mounting portion 324 include a mounting surface 3241 at a bottom thereof and a reflecting surface 3242 above and surrounding the mounting surface 3241. The reflecting surface 3242 is adjacent to the mounting surface 3241. The light emitting unit 33 is mounted on the mounting surface 3241 of the mounting portion 324.

In this embodiment, the lens 36 received in the interior 323 of the illumination device 30 is horizontally mounted to an inner surface of the transparent cover 31 and located above the light emitting units 33. The lens 36 includes a light incident surface 361 and a plurality of micro-structures 362. The micro-structures 362 are formed on the light incident surface 361. The micro-structures 362 are configured for diffusing the light from the light emitting units 33, which are LEDs 33. The lens 36 is configured for uniformly transmitting the light therethrough. The micros-structures 362 have a saw-toothed configuration.

The angle between the mounting plates 322 and the main body 321 is determined by the required light emitting angle of the illumination device 30. A part of light generated by the LEDs 33 is reflected by the reflecting surfaces 3242 to radiate out of the illumination device 30, whereby a more even illumination can be obtained.

Because the heat-dissipation modules 12, 22, 32 disclosed dissipate heat generated by the LEDs 13, 23, 33, the heat-dissipation efficiency of the illumination devices 10, 20, 30 is increased effectively. Moreover, the efficiency of the illumination devices 10, 20, 30 is improved by use of the reflecting shells 14, 24 and the reflective surfaces 3242 and the lens 36.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An illumination device comprising:

a cover;

a heat-dissipation module comprising a main body and a mounting plate connected to the main body, the mounting plate received in an interior of the illumination device cooperatively defined by the cover and the heat-dissipation module; and a plurality of light emitting units mounted on the mounting plate and opposite to the cover, the light from the light emitting unit transmitted through the cover;

wherein the heat-dissipation module comprises two mounting plates with a slot defined therebetween.

2. The illumination device as claimed in claim 1, wherein the light emitting units are LEDs.

3. The illumination device as claimed in claim 1, wherein the illumination device further comprises a reflecting shell mounted on the mounting plates, the reflecting shell being located between the light emitting units.

4. The illumination device as claimed in claim 1, wherein the cover and the heat-dissipation module are semi-cylindrical and cooperatively form a hollow column.

5. The illumination device as claimed in claim 1, wherein the mounting plate comprises a plurality of recessed mounting portions, each comprising a mounting surface at a bottom thereof and a reflecting surface adjacent to the mounting surface, wherein the light emitting units are mounted on the mounting surfaces.

6. The illumination device as claimed in claim 1, wherein the illumination device further comprises a lens with a plurality of micro-structures formed on a surface thereof facing the light emitting units, the lens being received in the interior of the illumination device and uniformly transmitting light from the light emitting units.

7. The illumination device as claimed in claim 1, wherein a plurality of micro-structures is formed on an inner surface of the cover opposite to the mounting plate, for uniformly transmitting light from the light emitting units.

8. An illumination device comprising:

a heat dissipation module made of metal and comprising a hollow body and a mounting plated formed on an end of the hollow body;

a plurality of LEDs mounted on the mounting plate and thermally connecting therewith;

a transparent cover mounted on the mounting plate and covering the LEDs;

reflective means for reflecting at least a part of light generated by the LEDs before the light is radiated out of the cover; and light diffusing means for diffusing the light generated by the LEDs before the light is radiated out of the cover.

9. The illumination device of claim 8, wherein the light diffusing means comprises saw-toothed micro-structures.

10. The illumination device of claim 9, wherein the saw-toothed micro-structures are formed on an inner surface of the cover.

11. The illumination device of claim 9, wherein the saw-toothed micro-structures are formed on a lens mounted to the cover and located above the LEDs.

12. The illumination device of claim 8, wherein the LEDs are arranged in at least two rows and the reflecting means comprises an arced reflecting shell located between the at least two rows of the LEDs.

13. The illumination device of claim 8, wherein the LEDs are arranged in a circle and wherein the reflecting means comprises an arced reflecting shell surrounded by the LEDs.

14. The illumination device of claim 8, wherein the mounting plate defines a plurality of recessed mounting portions each with a bottom mounting surface and a reflective surface adjacent to the mounting surface, the LEDs each being mounted on a corresponding mounting surface and the reflective means being formed by the reflective surfaces.

15. The illumination device of claim 14, wherein the mounting plate is inclined inwardly and away from the cover.

16. An illumination device comprising:

a cover;

a heat-dissipation module comprising a main body and a mounting plate connected to the main body, the mounting plate received in an interior of the illumination device cooperatively defined by the cover and the heat-dissipation module; and a plurality of light emitting units mounted on the mounting plate and opposite to the cover, the light from the light emitting unit transmitted through the cover;

wherein the illumination device further comprises a lens with a plurality of micro-structures formed on a surface thereof facing the light emitting units, the lens being received in the interior of the illumination device and uniformly transmitting light from the light emitting units.

* * * * *